US005226786A

United States Patent [19]

Dorski et al.

[11] Patent Number: 5,226,786

[45] Date of Patent: Jul. 13, 1993

[54] COOLANT PUMP DRIP COLLECTOR WITH SPLASH CONTROL

[75] Inventors: Ronald L. Dorski, Castalia; Steven F. Baker, Bellevue; Brent R. Behrman, Norwalk, all of Ohio

[73] Assignee: General Motors Corporation, Detroit, Mich.

[21] Appl. No.: 929,545

[22] Filed: Aug. 14, 1992

[51] Int. Cl.[5] ..... F04D 29/00

[52] U.S. Cl. ..... 415/168.2; 277/53

[58] Field of Search ..... 415/168.1, 168.2; 277/53

[56] References Cited

U.S. PATENT DOCUMENTS 4,722,662 2/1988 Morgan ..... 415/168.2

5,071,316 12/1991 Diem et al. ..... 415/168.1

5,154,576 10/1992 Dorski et al. ..... 415/168.2

5,168,626 12/1992 Dorski et al. ..... 29/428

*Primary Examiner*—Edward K. Look

*Assistant Examiner*—Michael S. Lee

*Attorney, Agent, or Firm*—Patrick M. Griffin

[57] ABSTRACT

A drip collector installed to a vehicle coolant pump of the type that has a protruding cylindrical bearing race with vent holes includes a feature to prevent collected coolant from splashing out, but not preventing it from collecting in the first instance. The collector includes at least one axially extending cylindrical sleeve that overlays the vent hole, with a small radial gap from the outside of the bearing race. Leaking coolant can run slowly through the gap, but cannot splash out quickly.

2 Claims, 3 Drawing Sheets

COOLANT PUMP DRIP COLLECTOR WITH SPLASH CONTROL

This invention relates to vehicle coolant pump drip collectors in general, and specifically to a drip collector that has a feature for controlling splash out of the collected coolant.

BACKGROUND OF THE INVENTION

Vehicle coolant pumps, generally called water pumps, separates a pump shaft bearing from a hot, coolant containing housing with a rotating coolant seal. The seal is inevitably subject to some small leakage, and a vent hole is provided between the coolant seal and the pump shaft bearing to allow the leaked coolant to exit before reaching the bearing. While this controlled leakage is expected and harmless to the pump operation, it can, by dripping on the engine block or garage floor, cause an aesthetic problem, or even suggest a seal failure that has not occurred in fact.

In response, various designs have been proposed for drip collectors that temporarily retain the leakage until it can evaporate, thereby preventing any visible dripping. One type of water pump currently used by the assignee of the subject invention has a cylindrical outer bearing race that protrudes axially outwardly from the front face of the pump housing, with a vent hole in the race axially spaced from the pump housing face. A drip collector for such a pump can take the basic form of an annular channel inserted over the bearing race and vent hole. Leaking coolant collects and puddles at the bottom of the channel, evaporating over time. One example of such a design is shown in U.S. Pat. No. 5,071,316 to Diem et al. One shortcoming of the design shown there is that a vehicle disturbance such as a bump may cause some collected coolant to splash out of the collector.

SUMMARY OF THE INVENTION

The invention provides a drip collector for a pump of the general type described above that substantially prevents collected coolant from splashing out.

In the preferred embodiment disclosed, the collector consists of first and second housing parts that snap together to create a channel that fits over the protruding bearing race, forming an enclosed annular collection space that surrounds the vent hole. The first housing part has a longer cylindrical sleeve that projects axially out therefrom far enough to cover the vent hole, with a diameter larger than, but close to, the bearing race. The second housing part has a shorter cylindrical sleeve that projects axially in, with a diameter larger than, but close to, the sleeve of the first housing part. When the housing parts are snapped together and installed, the longer sleeve surrounds and extends over the vent hole, with a small radial gap from the outer surface of the bearing race. In addition, the shorter and longer sleeves axially overlap one another, with a small radial gap between them. Leaking coolant, which does not run out of the vent hole at a rapid rate, can easily run through the radial gaps and into the collector. Collected coolant can also evaporate later slowly to ambient, but cannot splash suddenly out, because of the surrounding shield created by the overlaying cylindrical sleeves. In addition, the vent hole is shielded against intrusion of the dust or the like from outside the collector.

DESCRIPTION OF THE PREFERRED EMBODIMENT

These and other objects and features of the invention will appear from the following written description, and from the drawings, in which.

Figure 1:
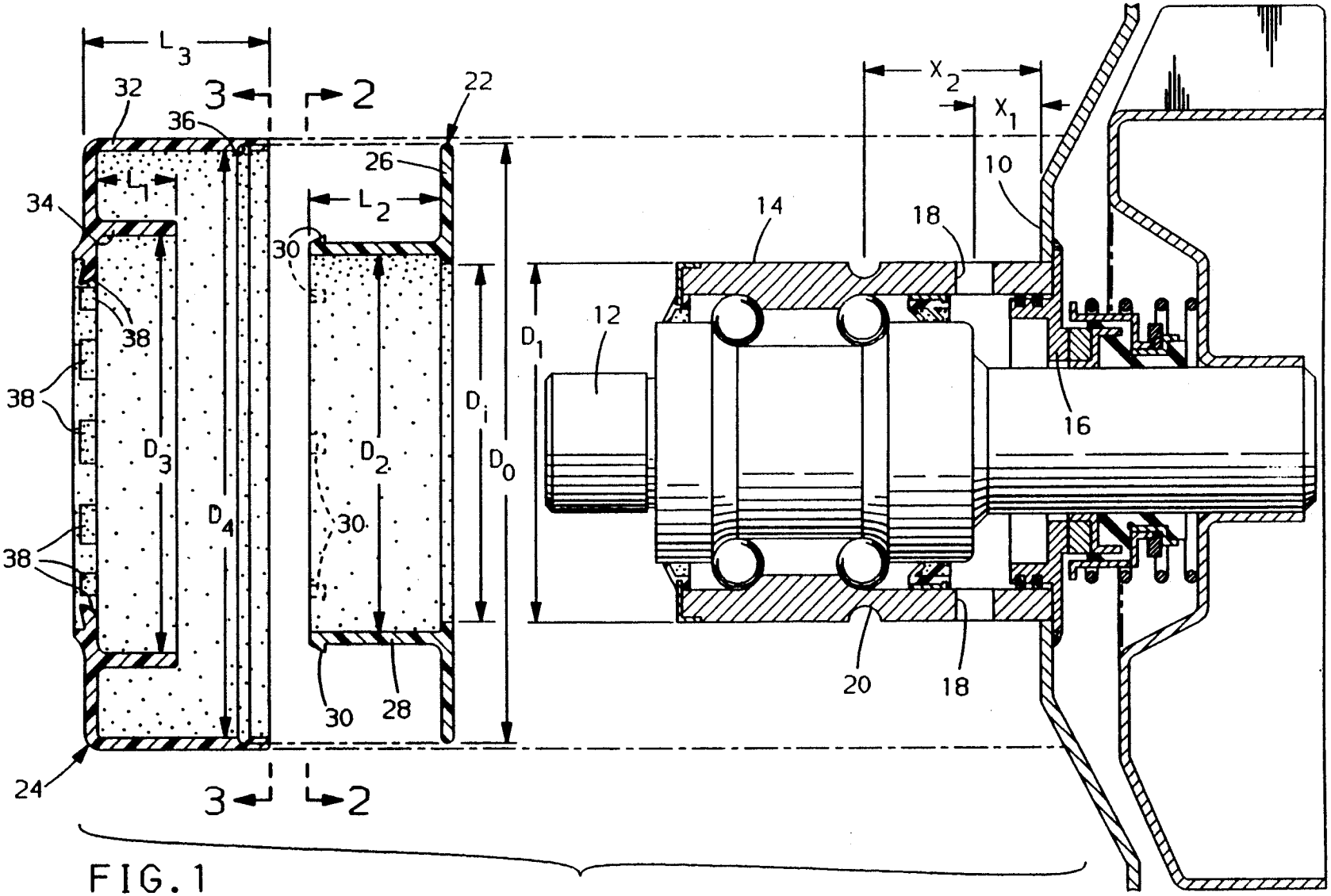
FIG. 1 is a cross section of a pump housing and bearing race with the pump shaft shown in elevation, and also showing the two housing parts in cross section before installation.

Referring first to FIG. 1, a vehicle coolant pump includes a stamped steel housing indicated by a front face (10), through which a pump shaft (12) extends, supported by a cylindrical outer bearing race (14) that protrudes from the front face (10), with a predetermined diameter $D_1$. A conventional pump seal (16) is subject to the kind of expected leakage described above, which is allowed to exit through a pair of diametrically opposed vent holes (18), each axially spaced away from face (10) by a predetermined distance $X_1$. In addition, bearing race (14) has a circular groove (20) spaced from face (10) by a distance $X_2$, which serves a purpose described below. Normally, the vent holes (18) would be directly open to ambient, and any leakage would drain directly out.

Figure 2:
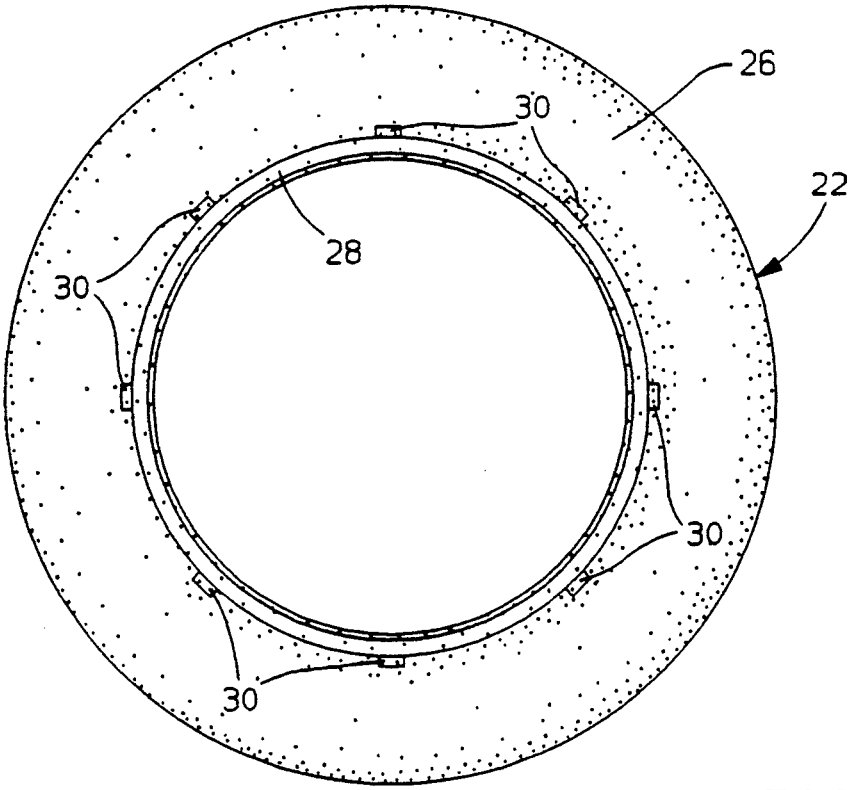
FIG. 2 is a view of the first housing part taken along the line 2—2 of FIG. 1.

Referring next to FIGS. 1 and 2, the invention comprises a pair of housing parts, a first part indicated generally at (22) and a second indicated generally at (24). Each housing part (22) and (24) is molded of a suitable plastic, and the two are designed to snap together to form a complete collector, in a manner described below. First housing part (22) is generally L-shaped in cross section, with an annular back wall (26) and a cylindrical sleeve (28) that extends axially outwardly therefrom. The various dimensions of first housing part (22) are critical to its cooperation with second housing part (24) and bearing race (14). The inner edge diameter of annular back wall (26), $D_i$, is substantially equal to $D_1$, while its outer edge diameter $D_o$ is dependent on a dimension of second housing part (24) described below. The diameter of sleeve (28), $D_2$, is slightly greater than $D_1$, and its length, $L_2$, is substantially greater than $X_1$, though somewhat less than $X_2$. The outermost edge of sleeve (28), as best seen in FIG. 2, also includes a spaced series of short, radial ribs (30), which serve a purpose described below.

Figure 3:
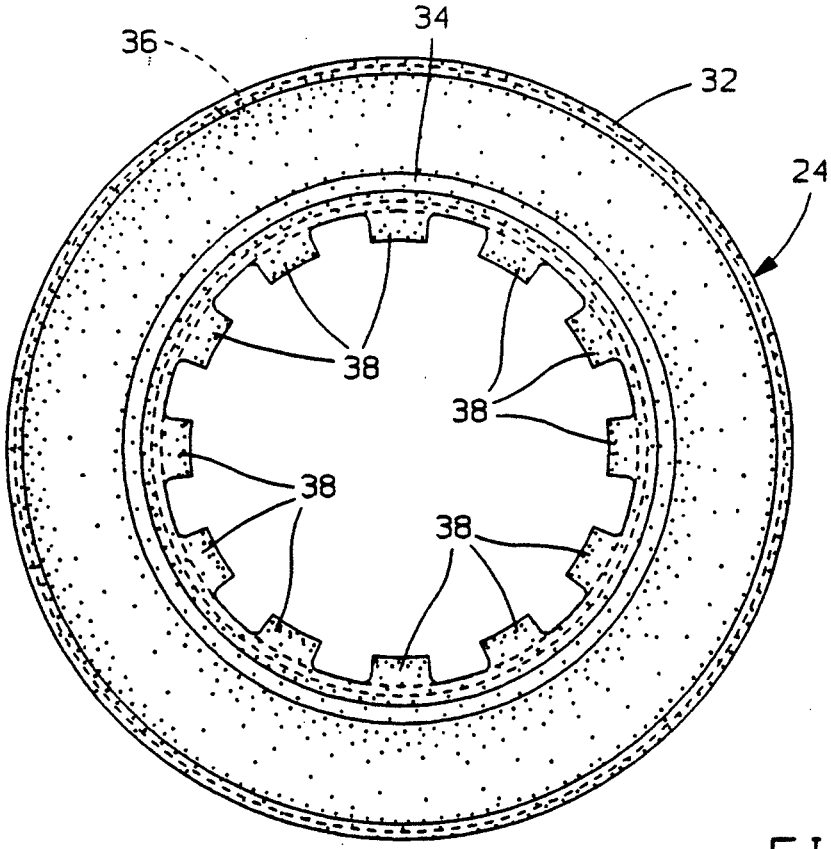
FIG. 3 is a view of the second housing part taken along the line 3—3 of FIG. 1.

Referring next to FIGS. 1 and 3, second housing part (24) is generally C or channel shaped in cross section, with two cylindrical sleeves projecting axially inwardly, an outer sleeve (32), and a shorter, inner sleeve (34). Outer sleeve (32) has a length $L_3$ substantially equal to $X_2$, and, therefore, greater than $L_2$, and a diameter $D_4$ just slightly less than $D_o$. Inner sleeve (34) has a diameter $D_3$ that is slightly greater than $D_2$, and a length $L_1$ less than $L_2$. The inner surface of outer sleeve (32) also has a circular groove (36) cut into it, and the innermost edge of second housing part (24) comprises a spaced series of flexible teeth (38) adapted to snap fit securely into bearing race groove (20).

Figure 4:
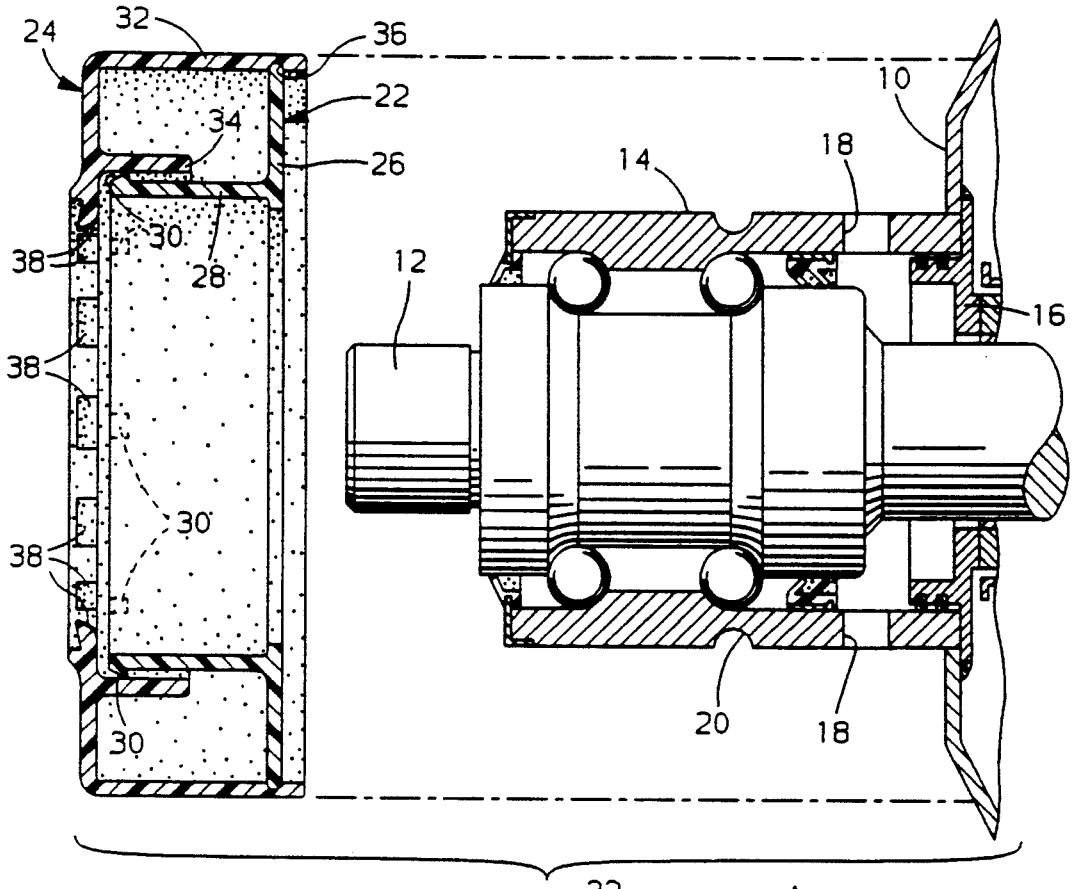
FIG. 4 is a view of the two housing parts snapped together to form the collector, still before installation.
Figure 5:
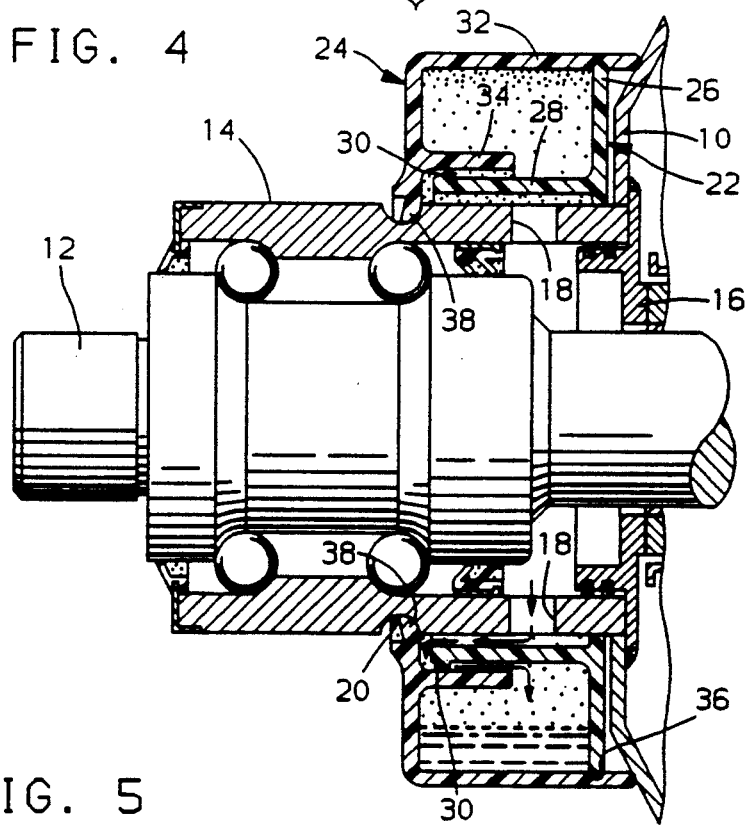
FIG. 5 is a view of the collector installed with a volume of collected coolant therein.

Referring next to FIGS. 4 and 5, a complex series of interrelationships between the various dimensions of the bearing race (14) and the housing parts (22) and (24) allows them to be assembled together and installed. First, the first and second housing parts (22) and (24) are slid coaxially one within the other. They nest together as shown in FIG. 4, and the outer edge of annular back wall (26) snaps into groove (36), holding the two securely together at a fluid tight joint. Because $L_3$ is greater than $L_2$, the edge of the longer sleeve (28) does not contact the second housing part (24). The two sleeves (28) and (34) axially overlap one another with a small radial gap between, given the relationship between $D_2$ and $D_3$. This gap is maintained by the ribs (30), which act as radial spacers. A generally annular, hollow collection space is formed between the outermost sleeve (32) and the two overlapping sleeves (28) and (34). Next, the teeth (38) are pushed over the outer surface of race (14), flexing until they snap into race groove (20). When installation is complete, annular back wall (26) is close to pump front face (10), with its inner edge very close to the outer surface of race (14).

Referring next to FIG. 5, the operation of the invention is illustrated. The longer sleeve (28) overlays and surrounds the vent holes (18), with a small radial gap from the outer surface of race (14), since $D_2$ is slightly greater than $D_1$. The overlapping sleeves (28) and (34), with the additional radial gap between them, forms a labyrinthine shield that separates the vent holes (18) from ambient. However, access for leakage from the vent holes (18) to the annular collection space is not blocked. Leakage will hit the surface of the surrounding sleeve (28), and run down under the force of gravity to bottom dead center. From there, it can move only to the right or to the left, as seen in FIG. 5. Its path to the right is blocked due to the close match of $D_i$ and $D_1$, but it can run to the left and down through the two radial gaps described above, as shown by the arrows, eventually puddling at and around bottom dead center of the annular collection space. There is also an evaporation path out between the sleeve (28) and the surface of race (14), then through the teeth (38) to ambient. While the radial gaps are not a barrier to the slow coolant leakage past seal (16), they do create a barrier to a sudden splash of collected coolant, as might be caused by a vehicle bump. The splashing coolant would hit the overlying shield of the overlapped sleeves (28) and (34), blocking and retaining it. In addition, the same tortuous path created by the small radial gaps that block splashing would also serve to retard the intrusion of dust or other outside particles through the vent holes (18).

Variations of the disclosed embodiment could be made. The drip collector could be assembled other than by snapping two parts like (22) and (24) together, so long as the same splash shield existed. It is much easier from a molding and manufacturing standpoint to make the two separate parts (22) and (24), however. Just the longer cylindrical sleeve (28), provided on either housing part (22) or (24), would, by virtue of overlying and closely surrounding the vent holes (18), serve as a splash shield. It is relatively simple to provide the overlapping shorter sleeve (34), however, to create even more splash protection. In fact, two shorter sleeves like (34), one overlapping each side of the longer sleeve (28), could be provided, creating an even more tortuous path, though this would take up some of the available coolant collection volume. Therefore, it will be understood that it is not intended to limit the invention to just the embodiment disclosed.

The embodiments of the invention in which an exclusive property or privilege is claimed are defined as follows:

1. A drip collector for use with a vehicle coolant pump having a front face and a cylindrical protrusion of predetermined diameter on said face, said protrusion also having at least one coolant vent hole from which leaking coolant exits said housing, said vent hole having a predetermined axial spacing from said face, said drip collector comprising, a generally annular collection space surrounding said vent hole, said collector further including an inner cylindrical sleeve projecting axially therefrom with a diameter slightly larger than said cylindrical protrusion and an axial length greater than said predetermined axial spacing, whereby, said sleeve shields said collection space from said vent hole with a small radial gap between said sleeve and said protrusion, so that liquid coolant may gradually pass through said radial gap into said collection space but will be prevented from easily splashing out of said collection space.

2. A drip collector for use with a vehicle coolant pump having a front face and a cylindrical protrusion of predetermined diameter on said face, said protrusion also having at least one coolant vent hole from which leaking coolant exits said housing, said vent hole having a predetermined axial spacing from said face, said drip collector comprising, a first housing part having a longer cylindrical sleeve projecting axially outwardly therefrom with a diameter slightly larger than said cylindrical protrusion and an axial length greater than said predetermined axial spacing, and, a generally channel shaped second housing part adapted to be secured to said first housing part in fluid tight fashion and having a shorter cylindrical sleeve with a diameter slightly larger than said first housing part sleeve, whereby, said first and second housing parts may be joined together and installed to said pump, thereby forming a generally annular collection space surrounding said vent hole and shielded by said longer and shorter sleeves axially overlapping one another with a radial gap therebetween and also between said longer sleeve and said bearing race, so that liquid coolant may gradually pass through said radial gaps into said collection space but will be prevented from easily splashing out of said collection space.

* * * * *